US007145517B1

(12) United States Patent
Cheng

(10) Patent No.: US 7,145,517 B1
(45) Date of Patent: Dec. 5, 2006

(54) ASYMMETRIC FLAT DIPOLE ANTENNA

(75) Inventor: Shih-Chieh Cheng, Tainan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 11/167,200

(22) Filed: Jun. 28, 2005

(51) Int. Cl.
*H01Q 9/28* (2006.01)
*H01Q 9/16* (2006.01)
*H01Q 21/00* (2006.01)

(52) U.S. Cl. ..... 343/795; 343/793; 343/801; 343/810

(58) Field of Classification Search ..... 343/793, 343/795, 801, 806, 794, 812, 810
See application file for complete search history.

(56) References Cited

U.S. PATENT DOCUMENTS 3,355,739 A * 11/1967 Bell et al. ..... 343/792.5
3,503,074 A * 3/1970 Carter ..... 343/792.5
6,417,816 B1 * 7/2002 Sadler et al. ..... 343/795
6,621,464 B1 * 9/2003 Fang et al. ..... 343/795
6,624,793 B1 * 9/2003 Su et al. ..... 343/795
2005/0110698 A1 * 5/2005 Surducan et al. ..... 343/795

* cited by examiner

*Primary Examiner*—Don Wong
*Assistant Examiner*—Angela M Lie
(74) *Attorney, Agent, or Firm*—Birch, Stewart, Kolasch & Birch, LLP

(57) ABSTRACT

An asymmetric flat dipole antenna includes a first radiating body, a second radiating body, and a conductivity element. The first radiating body has a first frequency radiator, at least two second frequency radiators, and a first electrically connecting part. The second radiating body also has a first frequency radiator, at least two second frequency radiators, and a second electrically connecting part. In the first and second radiating bodies, the first frequency radiator and the second frequency radiators are extended from a side of the first electrically connecting part or the second electrically connecting part. The first frequency radiator is neighbored on the second frequency radiators. The first frequency radiator and the second frequency radiators of the second radiating body are extended from the second electrically connecting part and have the extended direction reversed to the first radiating body. The conductivity element has a conductivity body electrically connected to the first electrically connecting part and a grounding conductor electrically connected to the second electrically connecting part.

11 Claims, 12 Drawing Sheets

Frequency : 2400 MHz
Peak Gain : -0.36dBi(@2°)
Average Gain : -0.77dBi

Frequency : 2450 MHz
Peak Gain : -1.08dBi(@176°)
Average Gain : -1.69dBi

Frequency : 2500 MHz
Peak Gain : -1.39dBi (@180°)
Average Gain : -2.14dBi

Frequency : 4900 MHz
Peak Gain : 0.86dBi (@187°)
Average Gain : 0.06dBi

Frequency : 5150 MHz
Peak Gain : 0.47dBi (@197°)
Average Gain : -0.50dBi

Frequency : 5250 MHz
Peak Gain : 0.63dBi (@197°)
Average Gain : -0.54dBi

Frequency : 5750 MHz
Peak Gain : 0.90dBi (@22°)
Average Gain : -0.19dBi

Frequency : 5850 MHz
Peak Gain : 0.78dBi (@19°)
Average Gain : -0.40dBi

ASYMMETRIC FLAT DIPOLE ANTENNA

BACKGROUND OF THE INVENTION

1. Field of Invention

The invention relates to a dipole antenna and, in particular, to an asymmetric flat dipole antenna.

2. Related Art

The prosperous development of the wireless transmission industry has carried out various products and techniques for multi-band transmission, so that many new products have the wireless transmission function so as to meet the consumer's demands.

The antenna, which is used for radiating or receiving the electromagnetic wave, is an important component in the wireless transmission system. The wireless transmission system would not work normally such as radiating or receiving data if it lacks of the antenna. Therefore, the antenna is indispensable in the wireless transmission system.

Choosing the suitable antenna not only can be contributive to collocate the appearance of product and to increase transmission characteristics, but also can decrease the production cost. Since the designing method and manufacturing materials are different when designing the antenna for varied application products, and the working frequency band are different in different countries, it is very critical for designing the antenna.

At present, the common specification of frequency band are the IEEE 802.11 and the IEEE 802.15.1 (Bluetooth communication) etc, wherein the Bluetooth communication is worked at frequency band of 2.4 GHz. The 802.11 includes 802.11a and 802.11b standards, which are defined for the frequency band of 5 GHz and 2.4 GHz, respectively.

Referring to FIG. 1, a conventional flat dipole antenna 1 includes a printed circuit board 11, a first dipole element 12, a second dipole element 13, and a feeding element 14. The first dipole element 12 and the second dipole element 13 are disposed on the printed circuit board 11, wherein the first dipole element 12 is consisted of a middle-strip 121, a first sub-strip 122, and a second sub-strip 123, which the first sub-strip 122 and the second sub-strip 123 are connected to the middle-strip 121, respectively. The second dipole element 13 is a bar microstrip. The feeding element 14 is electrically connected to the first dipole element 12 and the second dipole element 13, respectively. The flat dipole antenna 1 works at the different bands according to the n-structure of the first dipole element 12 coupled to the second dipole element 13.

However, there has different usable band in different countries, especially to the IEEE 802.11a standard. The component of the antenna must adapt to the range of different bandwidth, and, for example, the output must be a high band (5.47–5.725 GHz), 1 watt to adapt for all country channels in the Europe.

As mentioned above, the conventional dipole antenna only covers a part of the bandwidth, and the dipole antenna for application products, therefore, is unable to be applied in different countries because the available bandwidth is probably restricted in different countries or areas.

It is therefore a subject of the invention to increase the operation bandwidth of a flat dipole antenna to adapt to the requirement for more country areas.

SUMMARY OF THE INVENTION

In view of the above, the invention is to provide an asymmetric flat dipole antenna, which has wider bandwidth.

To achieve the above, a asymmetric flat dipole antenna of the invention includes a first radiating body, a second radiating body, and a conductivity element.

The first radiating body has a first frequency radiator, at least two second frequency radiators, and a first electrically connecting part. The first frequency radiator of the first radiating body and the second frequency radiators of the first radiating body are extended from a side of the first electrically connecting part. The first frequency radiator of the first radiating body is neighbored on the second frequency radiators of the first radiating body.

The second radiating body has a first frequency radiator, at least two second frequency radiators, and a second electrically connecting part. Each of the first frequency radiators of the first radiating body and the second radiating body has a first length and a first width, each of the second frequency radiators of the first radiating body and the second radiating body has a second length and a second width, wherein the first length is greater than the second length. Additionally, the first frequency radiator of the second radiating body and the second frequency radiators of the second radiating body are extended from a side of the second electrically connecting part with a direction reversing to an extending direction of the first radiating body. The first frequency radiator of the second radiating body is neighbored on the second frequency radiators of the second radiating body.

The conductivity element has a conductivity body and a ground conductor. The conductivity body and the ground conductor are electrically connected with the first electrically connecting part and the second electrically connecting part, respectively.

As mentioned above, the asymmetric flat dipole antenna of the invention utilizes the first frequency radiator of the first radiating body and the second frequency radiators of the first radiating body to couple to the first frequency radiator of the second radiating body and the second frequency radiators of the second radiating body. Thus, more coupling ways can be generated so as to increase the bandwidth of the asymmetric flat dipole antenna.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The asymmetric flat dipole antenna of the invention will be apparent from the following detailed description, which proceeds with reference to the accompanying drawings, wherein the same references relate to the same elements.

Figure 1:
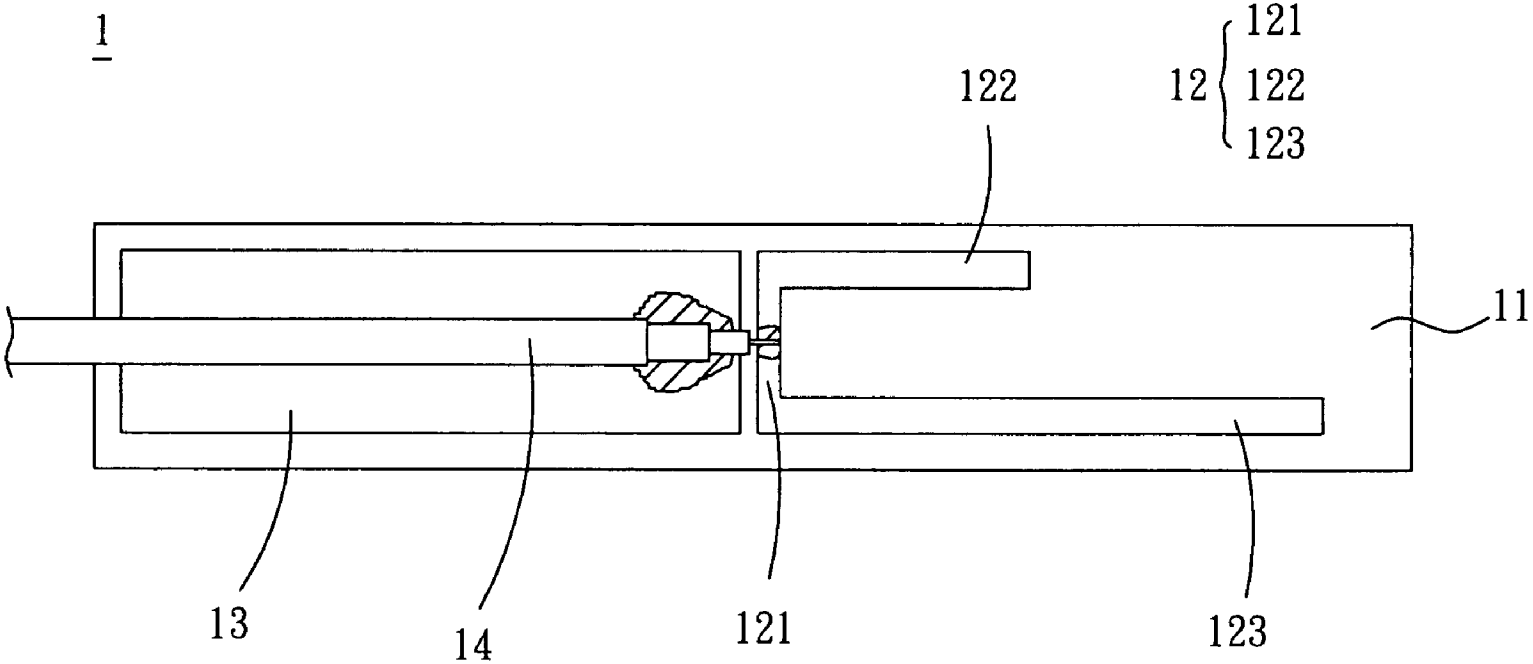
PRIOR ART FIG. 1
FIG. 1 is a schematic diagram showing a conventional flat dipole antenna.
Figure 2:
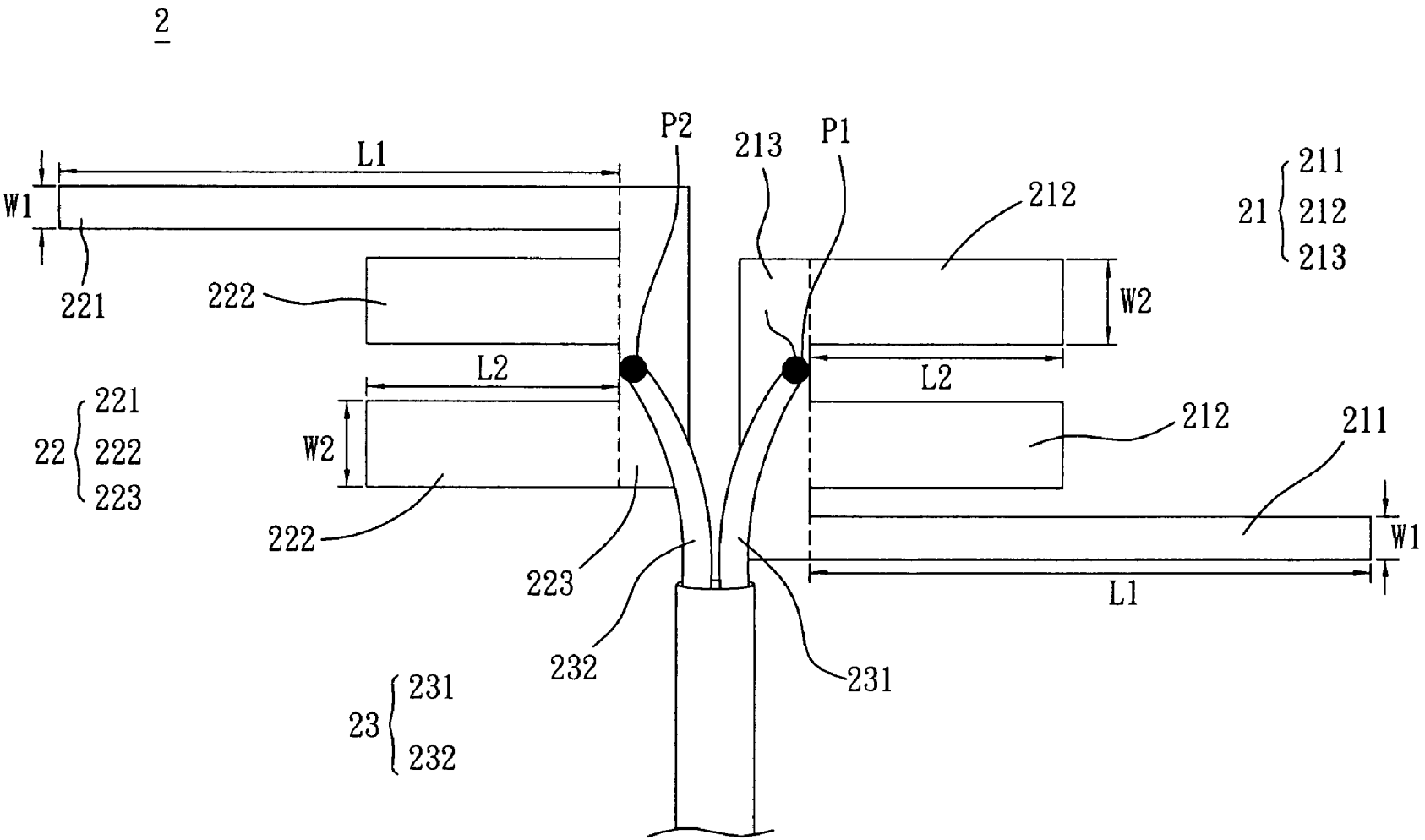
FIG. 2 is a schematic diagram showing an asymmetric flat dipole antenna according to an embodiment of the invention.

Referring to the FIG. 2, an asymmetric flat dipole antenna 2 according to an embodiment of the invention includes a first radiating body 21, a second radiating body 22, and a conductivity element 23.

The first radiating body 21 has a first frequency radiator 211, at least two second frequency radiators 212, and a first electrically connecting part 213. In the embodiment, the first frequency radiator 211 and the second frequency radiators 212 are rectangular.

The first frequency radiator 211 has a first length L1 and a first width W1, and each second frequency radiators 212 has a second length L2 and a second width W2, respectively. In the embodiment, the first width W1 is small than the second width W2 and the first length L1 is greater than the second length L2.

The first frequency radiator 211 and the second frequency radiators 212 are extended from a side of the first electrically connecting part 213, and the first frequency radiator 211 is neighbored on the second frequency radiators 212.

The second radiating body 22, which is similar to the first radiating body 21, has a first frequency radiator 221, at least two second frequency radiators 222, and a second electrically connecting part 223. In the embodiment, the first frequency radiator 221 and each second frequency radiator 222 of the second radiating body 22 are rectangular similar to the first frequency radiator 211 and each second frequency radiator 212 of the first radiating body 21. Similarly, the first frequency radiator 221 of the second radiating body 22 has the first length L1 and the first width W1, and each second frequency radiator 222 of the second radiating body 22 has a second length L2 and a second width W2.

The first frequency radiator 221 and the second frequency radiators 222 are extended from a side of the second electrically connecting part 223 with a direction reversing to an extending direction of the first radiating body 21. The first frequency radiator 221 of the second radiating body 22 is neighbored on the second frequency radiators 222 of the second radiating body 22.

In the embodiment, the first frequency radiator 211 of the first radiating body 21 and the first frequency radiator 221 of the second radiating body 22 are asymmetrically disposed and extended from the first electrically connecting part 213 and the second electrically connecting part 223, respectively.

Additionally, in the embodiment, the first frequency radiator 211 of the first radiating body 21 and the first frequency radiator 221 of the second radiating body 22 work at a band about 2.4 GHz, and the second frequency radiators 212 of the first radiating body 21 and the second frequency radiators 222 of the second radiating body 22 work at a band about 5 GHz.

The conductivity element 23 has a conductivity body 231 and a ground conductor 232. The conductivity body 231 and the ground conductor 232 are electrically connected with the first electrically connecting part 213 and the second electrically connecting part 223, respectively. In the embodiment, the conductivity body 231 is electrically connected with the first electrically connecting part 213, and the ground conductor 232 is electrically connected with the second electrically connecting part 223. Alternatively, the conductivity body 231 may be electrically connected with the second electrically connecting part 223, and the ground conductor 232 may be electrically connected with the first electrically connecting part 213 (not shown). In the embodiment, the conductivity element 23 is a coaxial line. The conductivity body 231 is used as the core conductor of the coaxial line, and the ground conductor 232 is used as the external conductor of the coaxial line. Moreover, based on the shape of the application products, the connecting ways of the conductivity element 23 with the first radiating body 21 and second radiating body 22 may be changed. It is the only concerned rule that the conductivity body 231 and the ground conductor 232 are electrically connected with the first electrically connecting part 213 and the second electrically connecting part 223, respectively.

In the embodiment, the first electrically connecting part 213 further includes a first feeding point P1, and the second electrically connecting part 223 further includes a second feeding point P2. The conductivity body 231 of the conductivity element 23 and the ground conductor 232 of the conductivity element 23 are electrically connected with the first feeding point P1 and the second feeding point P2, respectively.

Figure 3:
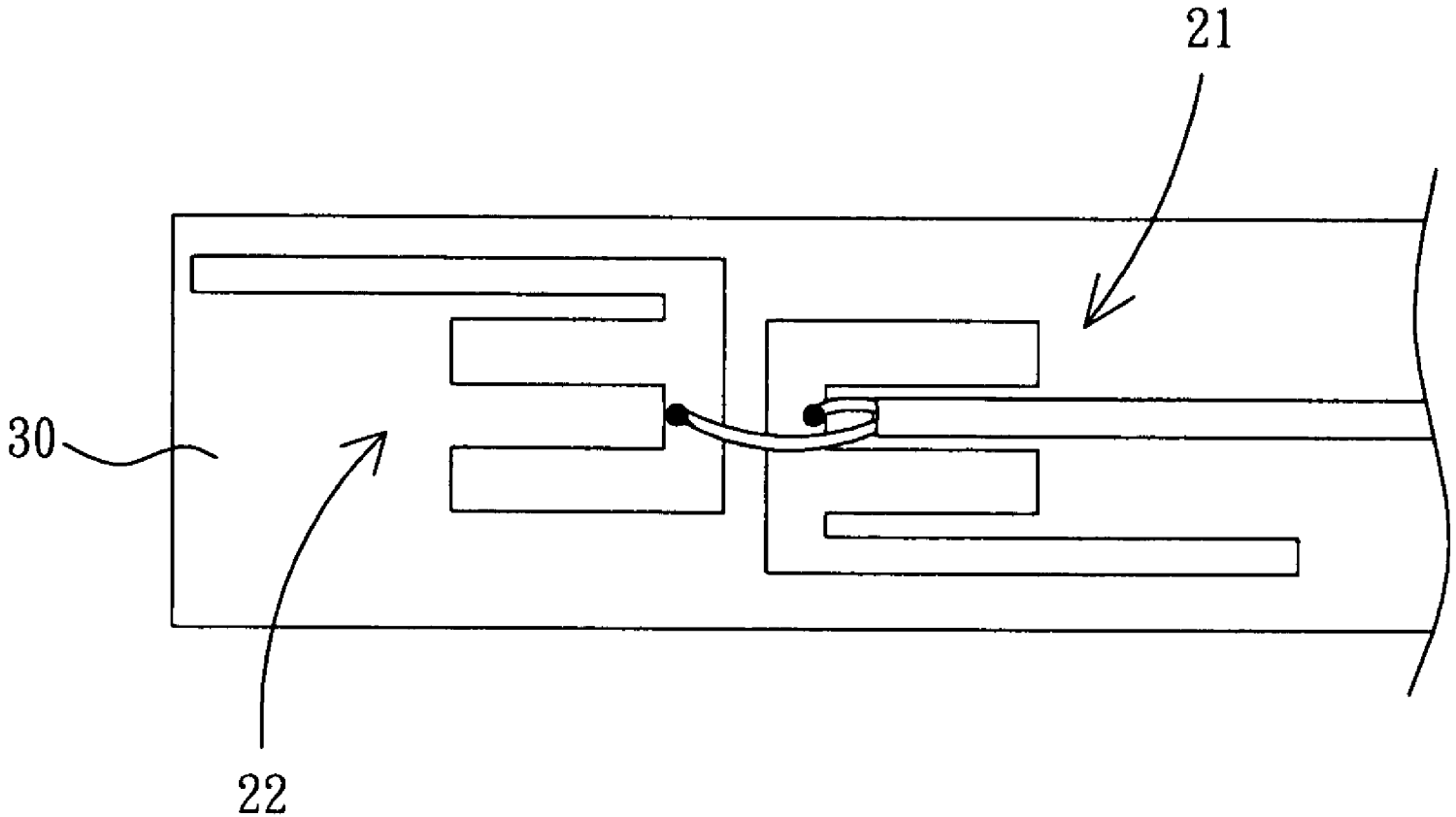
FIG. 3 is another schematic diagram showing the asymmetric flat dipole antenna according to the embodiment of the invention.

Referring to FIG. 3, in the embodiment, the first radiating body 21 and the second radiating body 22 of the dual band and broadband asymmetric flat dipole antenna 2 may be made of metal sheets. They may be disposed on a substrate 30 by printing or etching technology. The substrate 30 may be a printed circuit board (PCB), which is made of Bismaleimide-triazine (BT) resin or Fiberglass reinforced epoxy resin (FR4). Furthermore, the substrate 30 may be a flexible film substrate, which is made of polyimide. In some cases, the substrate 30 may be integrated into parts of the whole circuit to decrease the occupied space. In addition, the asymmetric flat dipole antenna 2 may be disposed on a surface of a shell (not shown), which is for the application product with the asymmetric flat dipole antenna 2, by utilizing evaporation deposition technology or other technologies.

Figure 4:
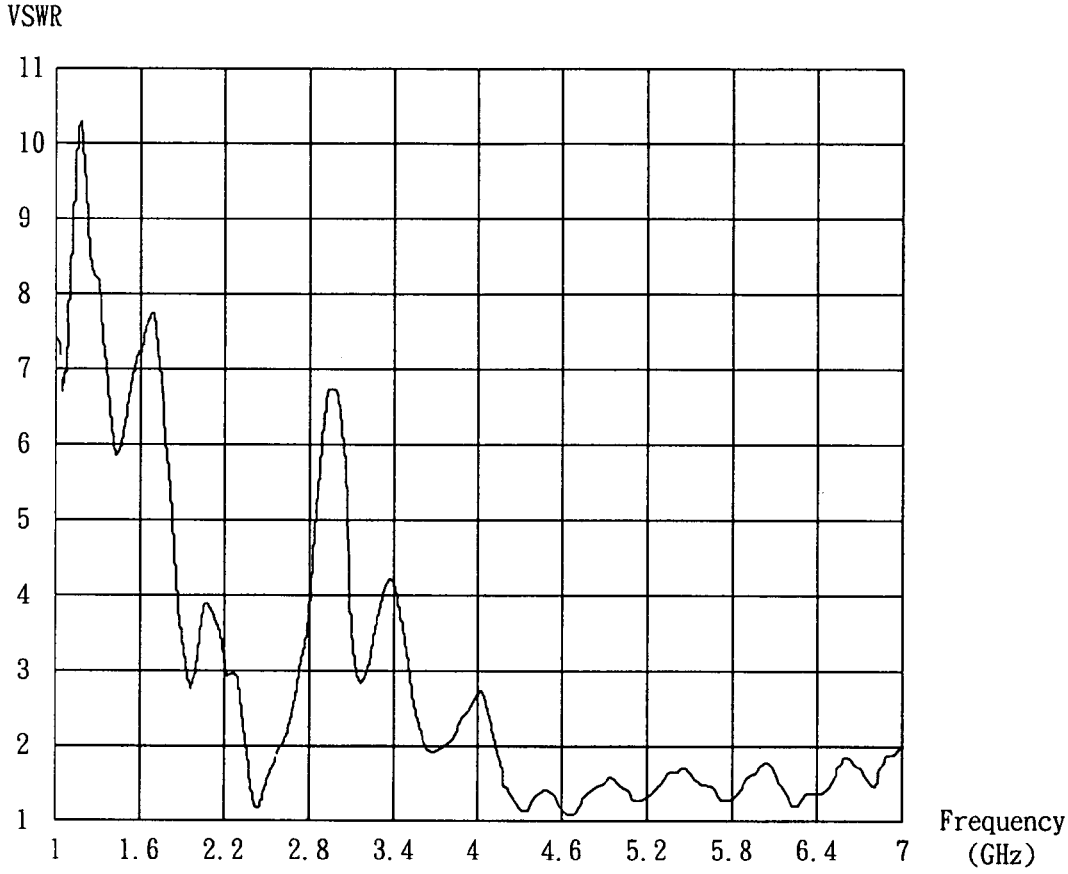
FIG. 4 is a measure diagram showing a VSWR of the asymmetric flat dipole antenna according to the embodiment of the invention.
Figure 5:
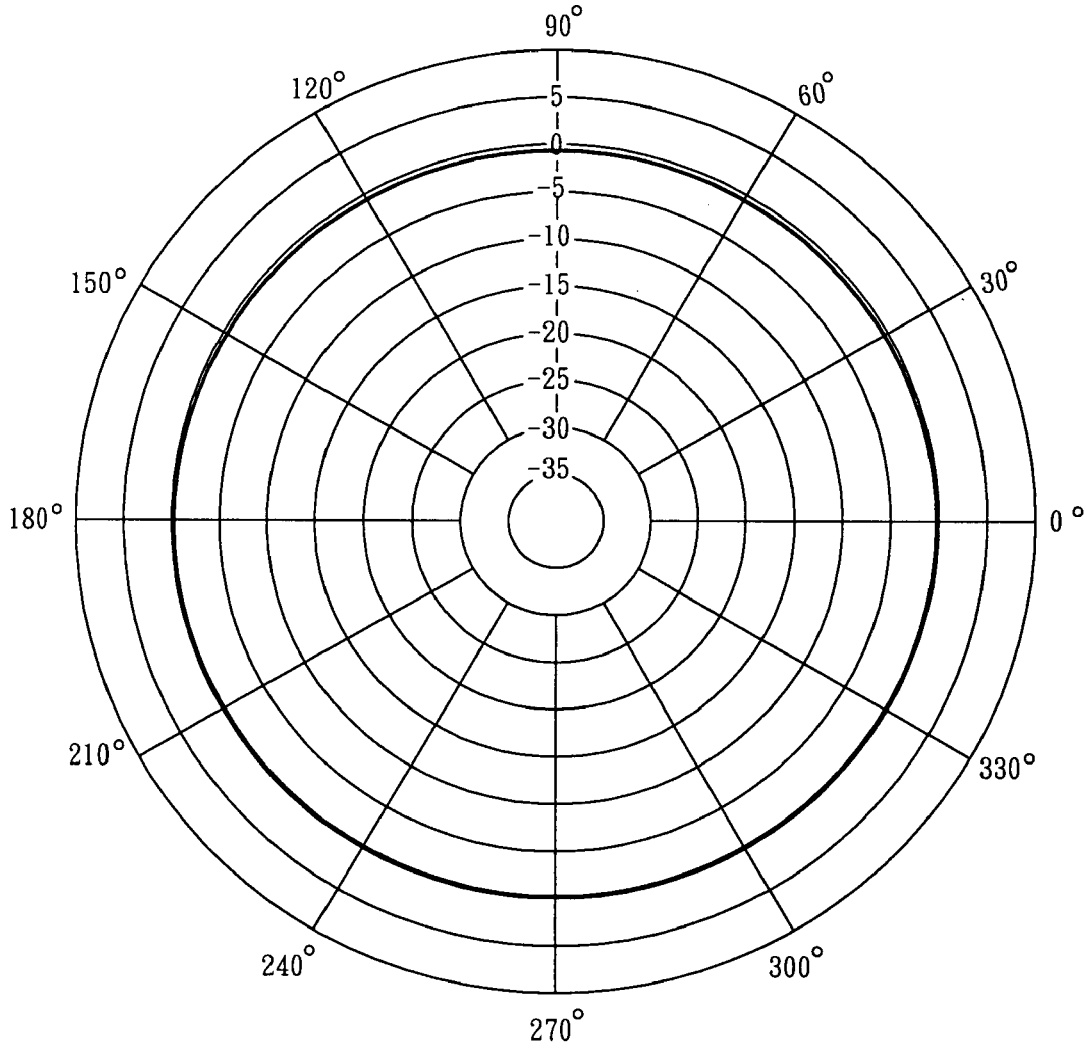
FIG. 5 is a measure diagram showing an H-plan of a radiation pattern of the asymmetric flat dipole antenna according to the embodiment of the invention works at the 2.4 GHz according to the embodiment of the invention.
Figure 6:
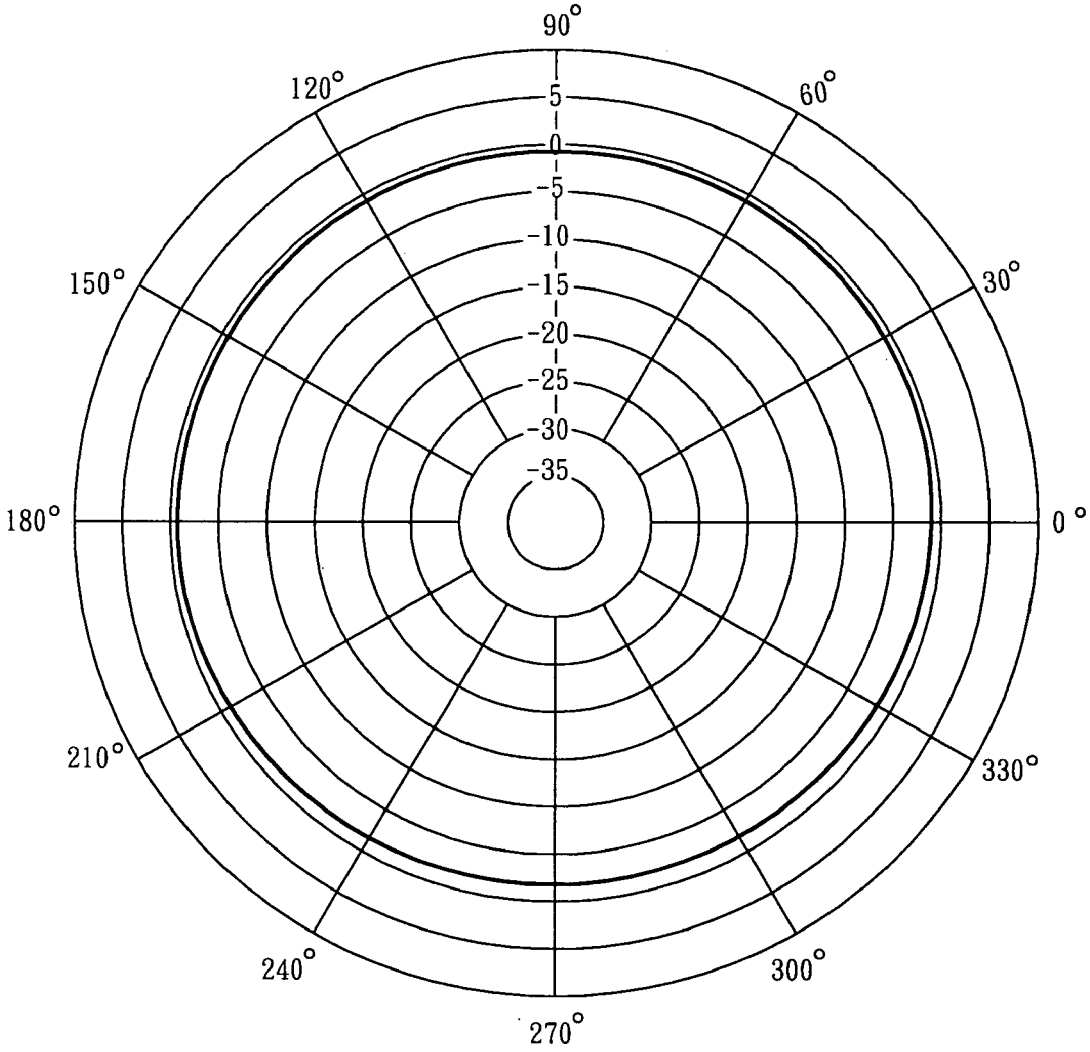
FIG. 6 is a measure diagram showing an H-plan of a radiation pattern of the asymmetric flat dipole antenna according to the embodiment of the invention works at the 2.45 GHz according to the embodiment of the invention.
Figure 7:
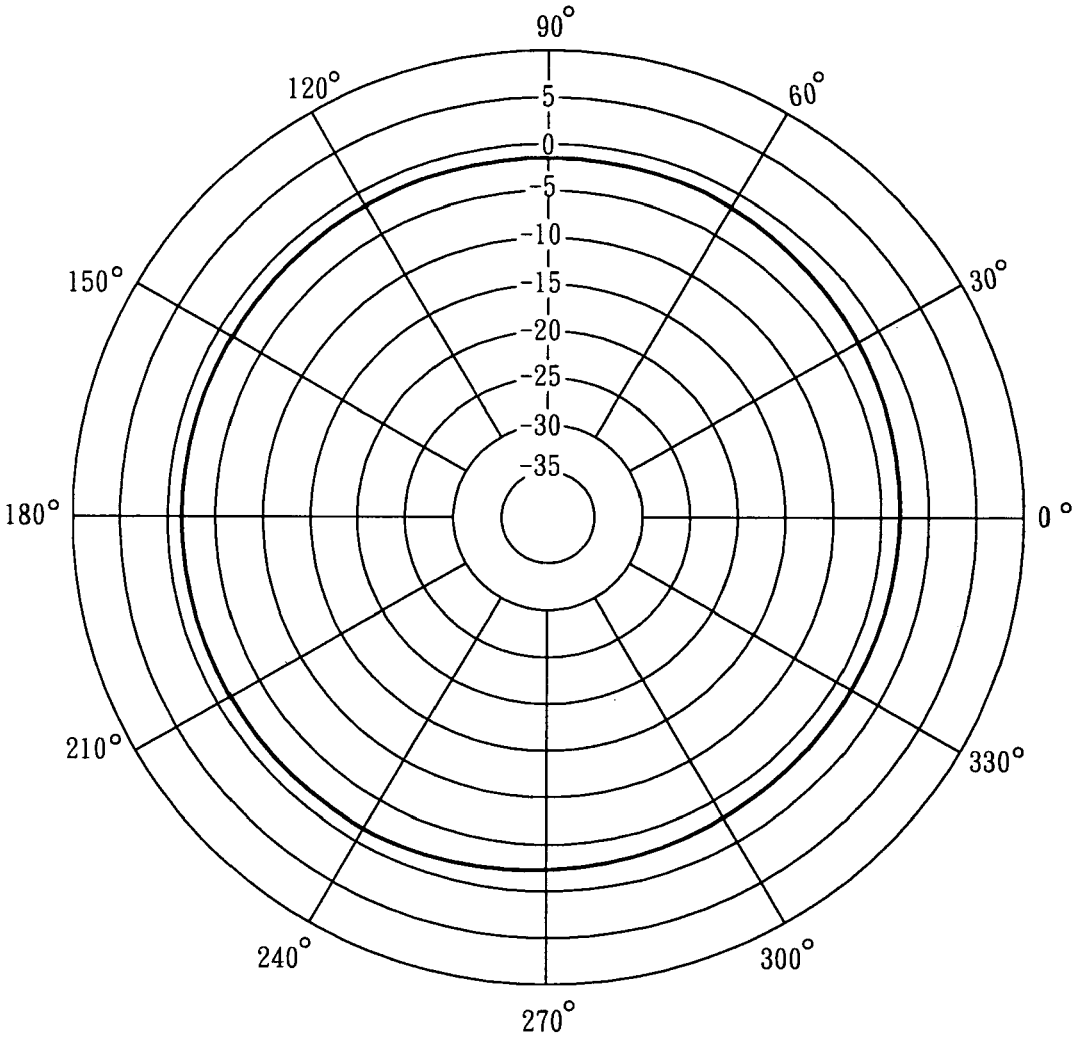
FIG. 7 is a measure diagram showing an H-plan of a radiation pattern of the asymmetric flat dipole antenna according to the embodiment of the invention works at the 2.5 GHz according to the embodiment of the invention.
Figure 8:
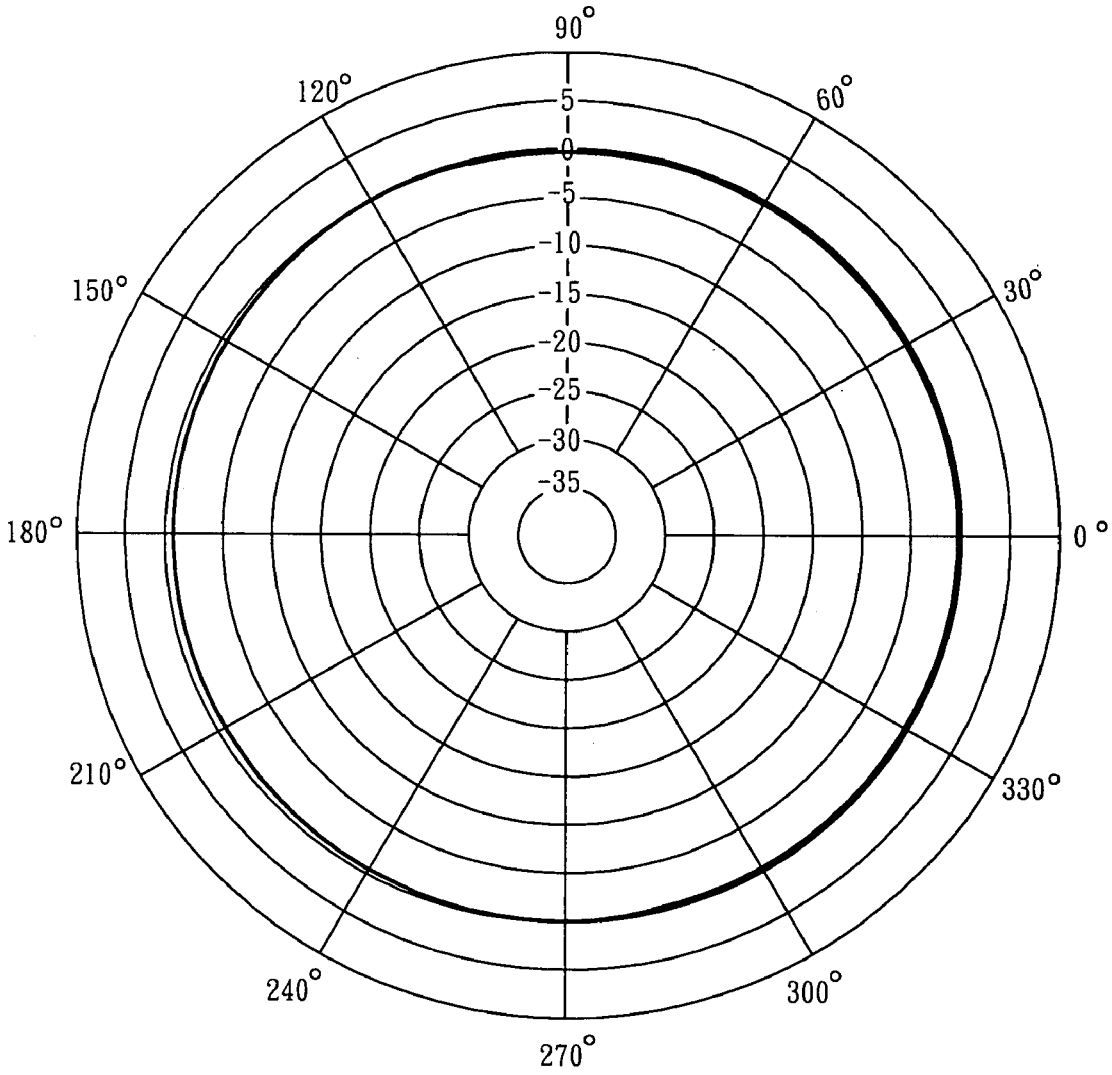
FIG. 8 is a measure diagram showing an H-plan of a radiation pattern of the asymmetric flat dipole antenna according to the embodiment of the invention works at the 4.9 GHz according to the embodiment of the invention.
Figure 9:
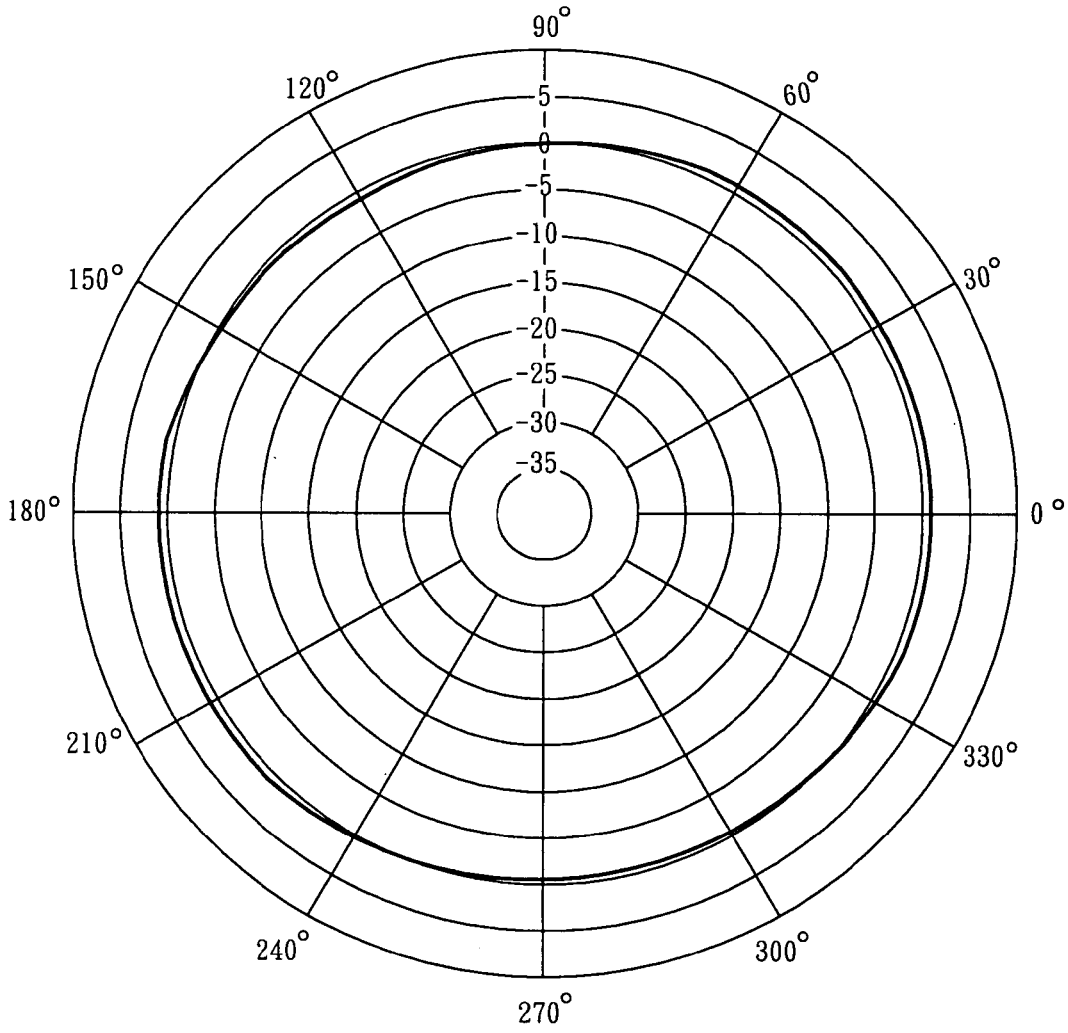
FIG. 9 is a measure diagram showing an H-plan of a radiation pattern of the asymmetric flat dipole antenna according to the embodiment of the invention works at the 5.15 GHz according to the embodiment of the invention.
Figure 10:
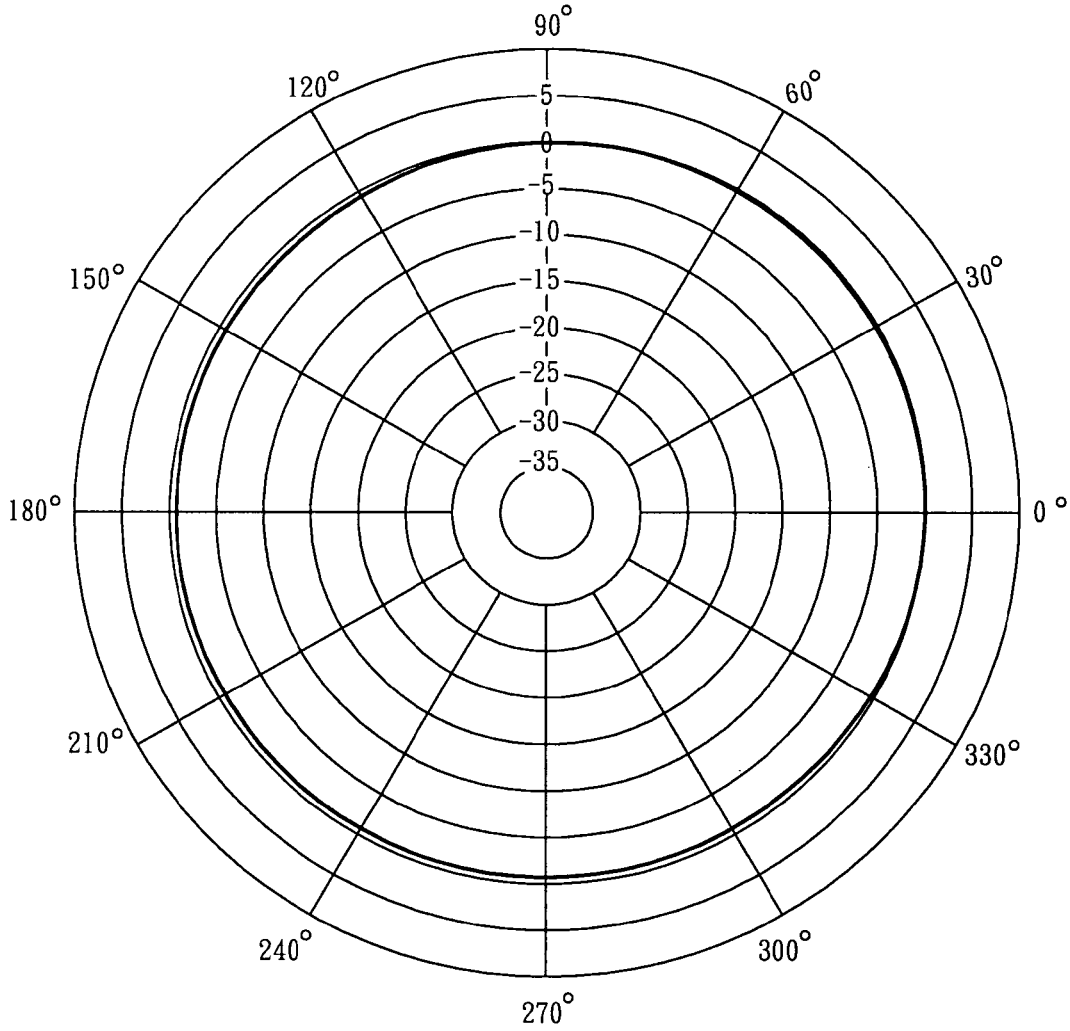
FIG. 10 is a measure diagram showing an H-plan of a radiation pattern of the asymmetric flat dipole antenna according to the embodiment of the invention works at the 5.25 GHz according to the embodiment of the invention.
Figure 11:
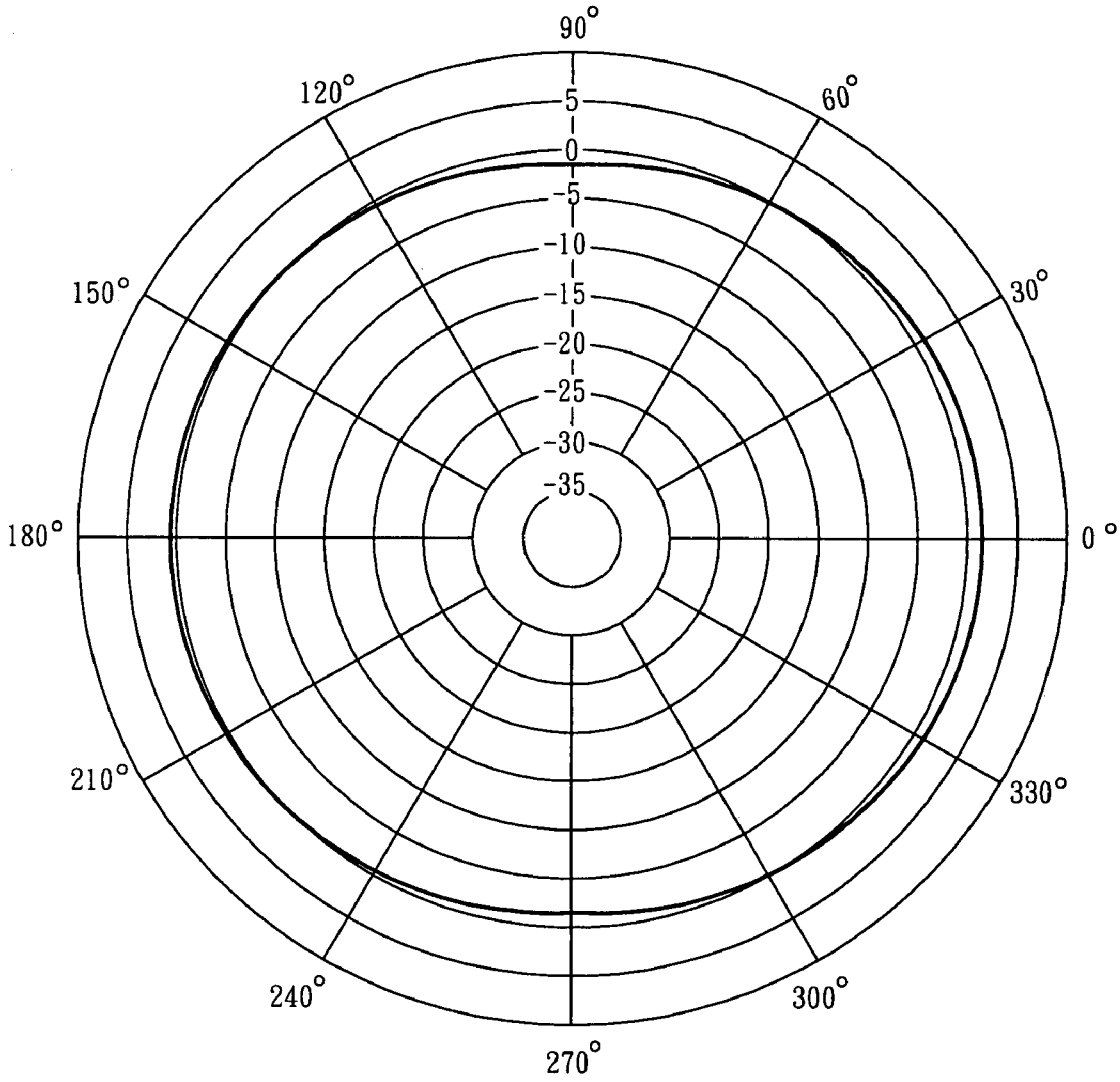
FIG. 11 is a measure diagram showing an H-plan of a radiation pattern of the asymmetric flat dipole antenna according to the embodiment of the invention works at the 5.75 GHz according to the embodiment of the invention.
Figure 12:
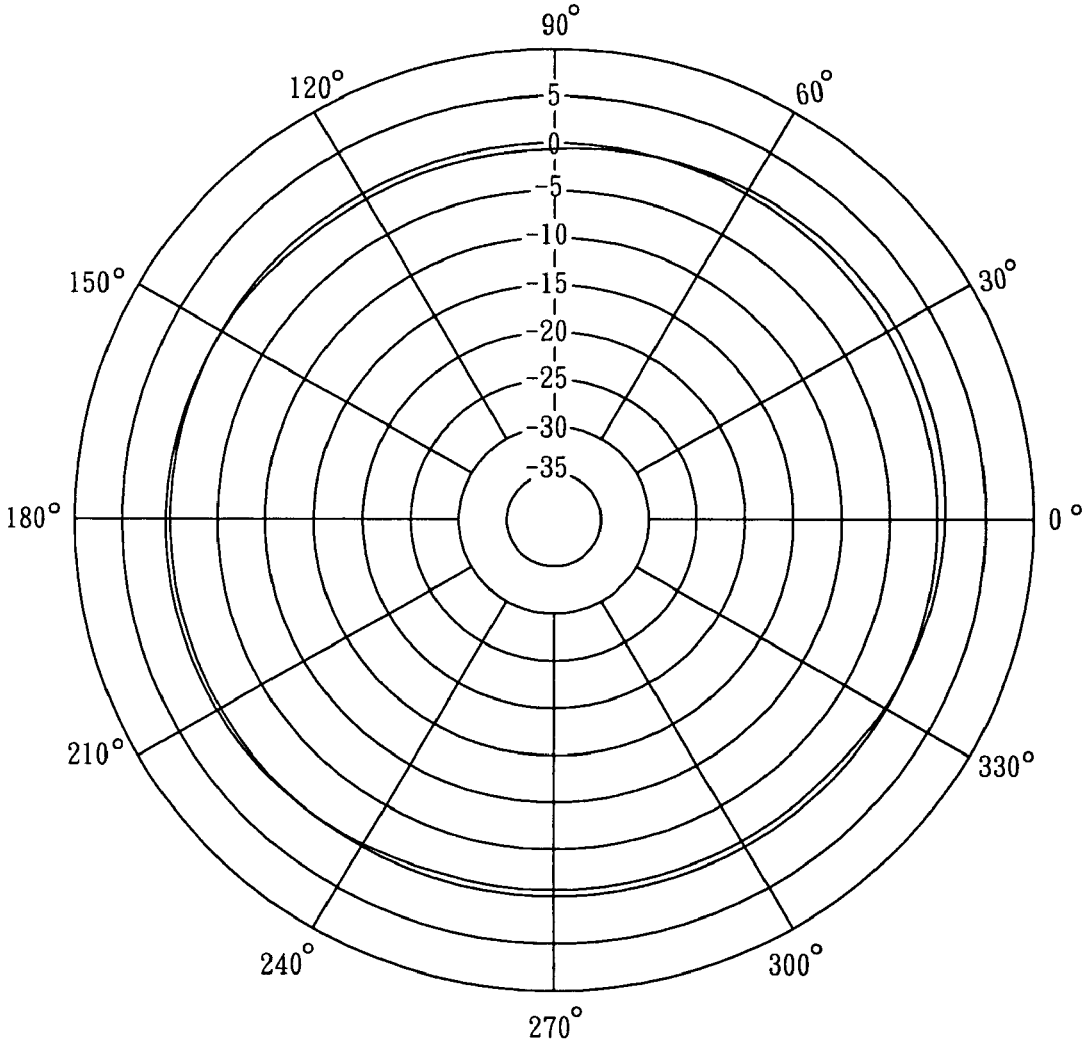
FIG. 12 is a measure diagram showing an H-plan of a radiation pattern of the asymmetric flat dipole antenna according to the embodiment of the invention works at the 5.85 GHz according to the embodiment of the invention.

Referring to FIG. 4, the vertical axis represents the voltage standing wave ratio (VSWR), and the horizontal axis represents the frequency. In general, the acceptable definition of the VSWR is smaller than 2, in the embodiment, the asymmetric flat dipole antenna 2 according to the embodiment of the invention not only can work at bands of 2.4 GHz and 5 GHz but also the asymmetric flat dipole antenna 2 of the embodiment can work at broader range of band. In the embodiment, the first frequency radiator 211 and 221 work between the frequencies about 2.3 GHz to 2.6 GHz, and the second frequency radiators 212 and 222 work between the frequencies about 4.1 GHZ to 7 GHz.

Referring to FIG. 5 to FIG. 12, which are measure diagrams showing H-plan of radiation patterns of the asymmetric flat dipole antenna 2 according to the embodiment of the invention works at 2.4 GHz, 2.45 GHz, 2.5 GHz, 4.9 GHz, 5.15 GHz, 5.25 GHz, 5.75 GHz, and 5.85 GHz, respectively.

In summary, the flat asymmetric dipole antenna of the invention utilizes the first frequency radiator 211 of the first radiating body 21 and the second frequency radiators 212 of the first radiating body 21 to couple to the first frequency radiator 221 of the second radiating body 22 and the second frequency radiators 222 of the second radiating body 22. Therefore, more coupling ways can be generated so as to increase the bandwidth of the asymmetric flat dipole antenna of the invention. The asymmetric flat dipole antenna of the invention can be applied for IEEE 802.11a, 802.11b, and 802.11g of the international specification. Moreover, it can be applied for the Ultra Wide Band (UWB). As a result, the asymmetric flat dipole antenna of the invention is useful and has better competitiveness.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An asymmetric flat dipole antenna, comprising:

a first radiating body having a first frequency radiator, at least two second frequency radiators, and a first electrically connecting part, wherein the first frequency radiator of the first radiating body and the second frequency radiators of the first radiating body are extended from a side of the first electrically connecting part, and the first frequency radiator of the first radiating body is neighbored on the second frequency radiators of the first radiating body;

a second radiating body having a first frequency radiator, at least two second frequency radiators, and a second electrically connecting part, wherein each of the first frequency radiators of the first radiating body and the second radiating body has a first length, each of the second frequency radiators of the first radiating body and the second radiating body has a second length, the first length is greater than the second length, the first frequency radiator of the second radiating body and the second frequency radiators of the second radiating body are extended from a side of the second electrically connecting part with a direction reversing to an extending direction of the first radiating body, and the first frequency radiator of the second radiating body is neighbored on the second frequency radiators of the second radiating body, the first frequency radiator of the first radiating body and the first frequency radiator of the second radiating body are asymmetrically disposed and extended from the first electrically connecting part and the second electrically connecting part; and a conductivity element having a conductivity body and a ground conductor, wherein the conductivity body and the ground conductor are electrically connected with the first electrically connecting part and the second electrically connecting part, respectively.

2. The antenna according to claim 1, wherein the first frequency radiators of the first radiating body and the second radiating body are rectangular.

3. The antenna according to claim 1, wherein the second frequency radiators of the first radiating body and the second radiating body are rectangular.

4. The antenna according to claim 1, wherein the first radiating body and the second radiating body are disposed on a substrate.

5. The antenna according to claim 1, wherein the first radiating body and the second radiating body are disposed on a shell.

6. The antenna according to claim 1, wherein each of the first frequency radiators of the first radiating body and the second radiating body has a first width, each of the second frequency radiators of the first radiating body and the second radiating body has a second width, the first width is smaller than the second width.

7. The antenna according to claim 1, wherein the first frequency radiator of the first radiating part and the second radiating part work at a band about 2.4 GHz.

8. The antenna according to claim 1, wherein the second frequency radiators of the first radiating part and the second radiating part work at a band about 5 GHz.

9. The antenna according to claim 1, wherein the conductivity element is a coaxial line.

10. The antenna according to claim 1, wherein the first electrically conducting part comprises a first feeding point electrically connected with the conductivity body or the ground conductor.

11. The antenna according to claim 10, wherein the second electrically conducting part comprises a second feeding point electrically connected with the conductivity body or the ground conductor.

* * * * *